US012790766B1

(12) United States Patent
Dicicco

(10) Patent No.: US 12,790,766 B1
(45) Date of Patent: Nov. 10, 2026

(54) TRACKING APPARATUS FOR USE WITH A MAT

(71) Applicant: LokOn Solutions, LLC, The Woodlands, TX (US)

(72) Inventor: Christy Richard Dicicco, The Woodlands, TX (US)

( * ) Notice: Subject to any disclaimer, the term of this patent is extended or adjusted under 35 U.S.C. 154(b) by 639 days.

(21) Appl. No.: 18/469,757

(22) Filed: Sep. 19, 2023

Related U.S. Application Data

(60) Provisional application No. 63/376,511, filed on Sep. 21, 2022.

(51) Int. Cl.
*E01C 9/08* (2006.01)

(52) U.S. Cl.
CPC ..... *E01C 9/086* (2013.01); *E01C 2301/00* (2013.01)

(58) Field of Classification Search
CPC ..... E01C 9/086; E01C 2301/00
USPC ..... 404/35, 40
See application file for complete search history.

(56) References Cited

U.S. PATENT DOCUMENTS

| | | | | |
|---|---|---|---|---|
| 5,653,551 | A | 8/1997 | Seaux | |
| 6,511,257 | B1 | 1/2003 | Seaux | |
| 6,695,527 | B2 | 2/2004 | Seaux | |
| 6,722,814 | B2 * | 4/2004 | Byrne | E01C 23/06 404/35 |
| 6,722,831 | B2 | 4/2004 | Rogers | |
| 8,414,217 | B2 | 4/2013 | Rosan | |
| 9,249,570 | B2 | 2/2016 | Jean | |
| 9,315,951 | B1 * | 4/2016 | Penland, Jr. | E04B 5/12 |
| 9,447,547 | B2 * | 9/2016 | Penland, Jr | E01C 5/18 |
| 9,447,548 | B2 * | 9/2016 | Penland, Jr. | E01C 5/20 |
| 9,663,902 | B2 * | 5/2017 | Penland, Jr. | E01C 5/22 |
| 9,663,903 | B2 * | 5/2017 | Penland, Jr. | E01C 5/22 |
| 9,714,487 | B2 * | 7/2017 | Penland, Jr. | B32B 15/18 |
| 10,017,903 | B2 * | 7/2018 | Penland, Jr. | B32B 15/095 |
| 10,273,638 | B1 * | 4/2019 | Penland, Jr. | E01C 5/18 |
| 10,358,776 | B1 * | 7/2019 | Yeu | E01C 5/22 |
| 10,753,050 | B2 * | 8/2020 | Penland, Jr. | E01C 9/086 |
| 2002/0192024 | A1 | 12/2002 | Webster | |
| 2007/0077120 | A1 | 4/2007 | Slater | |
| 2007/0280782 | A1 | 12/2007 | Rogers | |
| 2008/0292397 | A1 * | 11/2008 | Farney | E01C 9/086 404/32 |
| 2009/0087261 | A1 | 4/2009 | Fournier | |

FOREIGN PATENT DOCUMENTS

| | | | | |
|---|---|---|---|---|
| GB | 2638136 A | * | 8/2025 | E01C 9/08 |

* cited by examiner

*Primary Examiner* — Gary S Hartmann
(74) *Attorney, Agent, or Firm* — Egbert, McDaniel & Swartz, PLLC

(57) ABSTRACT

A tracking apparatus for use with a mat has a housing with an internal chamber and adapted to be fit into a hole of the mat, a tracking transducer positioned within an internal chamber of the housing, and a locking mechanism received in a cavity of the housing. The locking mechanism is rotatable between an unlocking position and a locking position. The locking position fixes the housing within the hole of the mat. The unlocking position allows the housing to be separated from the mat.

20 Claims, 7 Drawing Sheets

TRACKING APPARATUS FOR USE WITH A MAT

CROSS-REFERENCE TO RELATED APPLICATIONS

The application claims priority from U.S. Provisional Patent Application No. 63/376,511, filed on Sep. 21, 2022.

FIELD OF THE INVENTION

The present invention relates to mats. More particularly, the present invention relates to tracking apparatus that are adapted to follow and identify a location of the tracking device. More particularly, the present invention relates to tracking apparatus is applied to mats so as to identify a location and identity of a particular mat.

BACKGROUND OF THE INVENTION

When performing operations with heavy equipment in a remote location, it is often necessary to provide a firm, stable and continuous surface to support such heavy equipment. For example, when drilling a well in a remote location, it is often necessary to provide work surfaces used during the drilling process. It is also advantageous to provide one or more roadways to permit ingress to and egress from the remote location. The surface must provide sufficient support for the equipment and personnel involved in the work process and also must be able to withstand severe weather. The support surface must be capable of being quickly and easily installed and, thereafter, being easily removed and reused at other locations.

Wooden boards or planks have historically been used to construct temporary roadways and equipment support surfaces in remote or underdeveloped areas where the terrain lacks sufficient integrity to adequately support trucks and other heavy equipment. Such boards were generally placed end-to-end, or side-by-side, to form a continuous load-supporting surface. While individual wooden boards or planks have been used to construct support surfaces for some time, this method of building roadways and other load-bearing surfaces suffers from some significant disadvantages.

Because such a large number of individual wooden boards are generally required to construct a typical roadway or equipment support surface, the use of wooden boards can be very labor-intensive, since each board must first be individually positioned, and thereafter nailed or otherwise secured in place. The removal of the individual boards can also be a very time-consuming and labor-intensive process since each board must be separated or pulled apart prior to being removed from the location. Each individual board must also be loaded onto a truck or other means of transportation prior to being removed from the particular location or work site.

In order to overcome the aforementioned shortcomings associated with the use of individual boards, a variety of mat systems have been developed for the construction of temporary roadways and support surfaces. These mat systems typically utilize prefabricated, multi-layered mats which can be installed in a variety of configurations to create roadways or other support surfaces. These mats, which are constructed of a number of individual boards or planks affixed together in a variety OF configurations, are generally interconnected or intermeshed with one another to form a continuous, or nearly continuous, support surface.

U.S. Pat. No. 6,695,527, issued on Feb. 24, 2004 to Seaux et al., teaches one type of prior art reusable mat system for the construction of load-bearing surfaces, such as temporary roadways and equipment support surfaces. FIGS. 1-4 herein reference the structure of this prior art interlocking mat system. This interlocking mat system is typical of various mat systems that have been developed, employed, and sold by various companies throughout the United States. For example, FIG. 1 shows an individual mat that is part of a pair of mirror-image half-piece components that are affixed together to form a single mat. FIG. 1 depicts half-piece component 10. This half-piece component has a plurality of hexagonal honeycombs 12. This open-faced cellular structure is generally comprised of interconnecting cell-forming walls 13, which define the hexagonal honeycombs. The cell-forming walls 13 are integrally attached to a roughly continuous skin along one edge of the honeycombs. This defines a generally planar work surface on one side of the half-piece. Two adjacent peripheral edges 14 and 15 of the half piece 10 define areas having roughly continuous outer surfaces. Additionally, one or more recessed receptacles 16 are disposed through edges 14 and 15. These recessed receptacles 16 have a generally ovoid configuration. A plurality of holes 17 are disposed through the half-piece 10 for receiving bolts or other fastening devices.

The half piece 10 is joined with and permanently affixed to a mirror-image half-piece. These half-pieces are oriented such that the areas of reduced material, that is, the cellular structure, on opposing half-pieces are aligned with one another such that only such sections of reduced material overlap. This orientation results in upper peripheral extensions along two adjacent edges of a complete mat. There are lower peripheral extensions along the remaining two sides of the complete mat.

Referring to FIG. 2, the hexagonal honeycomb 12 is defined by vertical cell forming walls 13. Roughly continuous skin 18 is formed along the base of honeycomb 12 to define a work surface 19. Peripheral edge 14 has roughly continuous outer surfaces 14*a* and 14*b*, as well as chamfered edge 14*c*. A recessed receptacle 16 is disposed to the peripheral edge 14. The recessed receptacle 16 has an upper recessed ledge 16*a* and lower recessed ledge 16*b*.

FIG. 4 shows a plurality of generally identical individual mats, such as mat 20. Mat 20 has an upper stratum defined by upper half-piece 21 and a lower stratum defined by lower half-piece 22. Lower half-piece 22 is roughly identical to half piece 10 depicted in FIG. 1. Upper half-piece 21 and lower half-piece 22 of mat 20 are mirror images of one another. Upper half-piece 21 has generally planar upper work surface 23. The lower half-piece 22 has a generally planar lower work surface 24. Upper half-piece 21 and lower half-piece 22 are mutually offset relative to each other. This results in upper peripheral extension 25 and lower peripheral extension 26. The peripheral edge 27 of upper half-piece 21 and peripheral edge 28 of lower half-piece 22 are chamfered along the full extent of these half-pieces. A plurality of raised traction promoting elements 23*a* are disposed on generally planar upper work surface 23, while a plurality of raised traction-promoting elements 24*a* are disposed on generally planar lower work surface 24.

FIG. 3 depicts a top plan view of an individual mat 20 which has upper half-piece 21 and lower half-piece 22 permanently affixed together. This defines upper peripheral extensions 25*a* and 25*b* on two adjacent edges of mat 20 and lower peripheral extensions 26*a* and 26*b* on the remaining two adjacent edges of mat 20. When two individual mats are placed together laterally for purposes of constructing a roadway or other support surface, lower peripheral extension 26*a* is received under upper peripheral extension 25*a* of an adjacent mat. Similarly, when two mats are placed together in longitudinal fashion, lower peripheral extension 26 of one mat is received under upper peripheral extension 25*b* of an adjacent mat.

FIG. 3 further shows that a plurality of raised traction promoting elements 23*a* are disposed on a generally planar work surface 23. These raised traction promoting elements are positioned proximate to and in general alignment with underlying cell forming walls. A plurality of holes 29 extend through mat 20 to receive bolts or other fastening devices to affix upper half piece 21 to mirror-image lower half-piece 22. Holes 29 have recessed ledges to permit the fastening means to be positioned below the generally planar work surface 23 in order to avoid any obstruction to traffic utilizing the work surface. Further, a plurality of recessed receptacles 30 are disposed along peripheral edges. Chamfered edge 28 extends along lower half-piece 22. Chamfered edge 26 extends around upper half-piece 22.

One of the problems associated with these prior art construction mats, such as those shown in FIGS. 1-4, is that they are relatively expensive. Since the construction mats that are sold throughout the United States tend to be of an identical or very similar construction, the mats originating from one manufacturer or owner often become mixed with the mats of another manufacturer or owner. After disassembly, these mats are typically mixed together for transportation back to a storage location or placed in further use. At this point in time, it becomes very difficult to identify which mat belongs to which manufacturer or owner. Furthermore, when the owners of these construction mats desire to locate their particular mats, identifying the location of these mats becomes nearly impossible. This can result to a significant loss to the manufacturer or owner of these particular construction mats. In terms of liability, it often becomes difficult to determine which construction mat has caused a particularly particular injury or problem after the construction mats have been placed into use. As such, a need has developed so as to be able to properly identify construction mats once the construction mats have been placed in use. Furthermore, the ability to locate the particular construction mat is also desirable. The ability to identify the location of the particular construction mat allows the owner and/or manufacturer to properly reclaim their construction mats and to properly control the inventory of such construction mats.

Tracking transducers are well known in the prior art. Tracking transducers can be in the nature of internal RFID tags. This can take the form of proximity tags that need to ping with an active reader. As such, proximity to the mat is necessary in order to identify the name and owner of such a mat. It does nothing to help provide the location of the particular mat. RFID tags are often installed by a manufacturer onto the particular construction mat.

The tracking transducers can also be in the nature of GPS, and Apple Air Tags™ or cell signal locators. To the extent that a GPS is installed onto the mat, it is important to consider an issue of battery life. The GPS must last more than five years. Also, the GPS must be added after the molding of the mat is complete. If the GPS units were added during the molding process, they can become compromised by temperature and/or pressure. It is difficult or impossible to install such GPS units during manufacturing. As such, there is a need to provide a tracking transducer for use in association with the mat in which the tracking transducer can be retrofit to the existing mat in a quick, simple and easy manner. It is also important that such a tracking transducer the able to be removed from the mat when desired.

In the past, various patents have issued with respect to construction mats. For example, U.S. Pat. No. 5,653,551, issued on Aug. 5, 1997 to O. P. Seaux, shows a reusable mat system for constructing roadways and equipment support surfaces. This reusable mat system has a plurality of uniform individual mats which are constructed of lightweight composite materials and which include strengthening agents. The individual mats partially overlap and interlock to form a continuous and smooth surface. The interlock prevents undesired movement of the mats on location and permits the quick installation of the mats by simple placement methods.

U.S. Pat. No. 6,511,257, issued on Jan. 28, 2003 to so Seaux et al., teaches a reusable mat system for the construction of load-bearing surfaces, such as temporary roadways and equipment support surfaces, over unstable or unsubstantial terrain. This reusable mat system comprises durable, interlocking individual mats that can be quickly and easily installed in a single application. The individual mats interlock on all sides to form stable and continuous load-bearing surfaces.

U.S. Pat. No. 6,722,831, issued on Apr. 20, 2004 to Rogers et al., teaches a fastening device for use with construction mats. This fastening device has a pin with an enlarged head and a central longitudinal bore to receive a rod having a head with a drive-receiving recess and a footed keeper. The pin and rod have adjacent surfaces that aid in the prevention of turning relative to each other. The pin has the footed keeper in alignment and is inserted to aligned openings in overlapping mats used in roadways. A tool is used to turn the keeper a quarter-turn to prevent the pin from coming out of the opening and securing the mat.

U.S. Pat. No. 8,414,217, issued on Apr. 9, 2013 to A. Rosan, describes a modular flooring system that is designed to support heavy loads while providing stability and ground protection. The modular mat has an integral main body with an offset mounting, assembly flanges and a lattice interior. The mat is constructed from a unitary piece of high-strength plastic. Each flange edge contains an outward radiused edge. Each non-flange edge contains an inward radiused edge. Each flange engages with a corresponding flange on an adjacent tile so as to allow the outward radiused and inward radiused edges to properly mate. One or more metal cam blocks located along the upper flange edges are secured into corresponding cam receptacles located along the lower flange edge.

U.S. Pat. No. 9,249,570, issued on Feb. 2, 2016 to N. Jean, teaches a system for constructing a load-bearing surface. The system includes a plurality of modular ground-covering panels. A lower surface projects beyond the upper surface to define a lower peripheral tab along at least one first side edge of each of the panels. The upper surface projects beyond the lower surface to define an upper peripheral tab along at least one second side edge of each of the panels. The lower peripheral tab of one of the panels and the upper peripheral tab of another of the panels overlaps and engage so that the upper surfaces of the panels are in adjoining relation to form the load-bearing surface. A connector assembly includes a first connection element fixed to the lower peripheral tab, and a second connection element that releasably fastens the upper peripheral tab to the first connection element to secure the panels together.

U.S. Patent Application Publication No. 2002/0192024, published in Dec. 19, 2002 to Webster et al., provides multipurpose panels that have L-shaped tabs that are interconnected using durable connectors to form a multipurpose mat that facilitates mobility over unstable terrain. Four-sided panels are fabricated from laminations of fiberglass-reinforced plastic with radiused rectangular holes machined into each of the two adjacent edges and a recessed L-shaped tab formed along opposing adjacent edges. The connectors are fabricated from corrosion-resistant metal and assembled to precise specifications prior to insertion into the rectangular holes. A threaded bolt is used to tie the panels together.

U.S. Patent Application Publication No. 2007/0077120, published on Apr. 5, 2007 to W. B. Slater, shows a grid-type platform suited for use for supporting vehicle wheels to provide traction while traveling off-road. This grid-type platform has a plurality of grid sections defined by intersectional lateral and longitudinal walls and having an intermediate support designed to provide traction to vehicles to reduce slippage.

U.S. Patent Application Publication No. 2007/0280782, published on Dec. 6, 2007 to Rogers et al., shows an overlapping secured mat system. This is a portable overlapping secured mat system with uniformly-sized flat plastic mats joined together to form structural support surfaces for use by persons or equipment. The edges of the mats have recessed upper and lower lips with finger projections extending from the upper lips that are sized to fit into holes of the adjacent mat's lower lips so as to secure the mats together when the front edge of the finger projections are moved into the recesses of the back wall of the hole.

U.S. Patent Application Publication No. 2009/0087261, published in Apr. 2, 2009 to R. Fournier, describes a reinforced groundcover mat that are comprised of boards contained within a metal frame. A structural support in the form of an I-beam encases the boards and the frame on one side. A tubular member is positioned on the other side.

It is object to the present invention to provide a tracking system for a mat which allows an owner and a location of the mat to be readily identified.

It is another object of the present invention provide a tracking system for a mat which allows the tracking transducer to be easily installed in the mat.

It is another object of the present invention to provide a tracking transducer for a mat which maintains the tracking transducer in a generally liquid-tight environment.

It is a further object of the present invention to provide a tracking system for a mat which allows the tracking transducer to be placed within a housing that can be quickly and easily installed and removed from the construction mat.

It is another object of the present invention to provide a tracking system for a mat wherein the housing containing the tracking transducer requires a key for the purposes of installation and/or removal.

It is a further object of the present invention to provide a tracking system for a mat which is easily retrofitted to virtually any existing construction mat.

It is another object of the present invention to provide a tracking system for a mat which is easy to use, easy to manufacture and relatively inexpensive.

These and other objects and advantages of the present invention will become apparent from a reading of the attached specification and appended claims.

BRIEF SUMMARY OF THE INVENTION

The present invention is a tracking apparatus for use with a mat. The mat has a plurality of holes formed adjacent a peripheral edge thereof. The mat has a top surface and a bottom surface. The tracking device comprises a housing having an internal chamber. The housing is adapted to fit into one hole of the plurality of holes of the mat. This housing has a cavity opening at a surface thereof. A tracking transducer is positioned within the internal chamber of the housing. A locking mechanism is received in the cavity of the housing. This locking mechanism is rotatable between an unlocking position and a locking position. The locking position fixes the housing within the hole of the construction mat. The unlocking position allows the housing to be separated from the construction mat.

The housing has a lip extending outwardly from a periphery adjacent to the top of the housing. The lip is adapted to overlie the top surface of the mat in an area adjacent to the one hole. To the extent that the area adjacent the hole is a recessed area, the lip is positioned within this recessed area.

The locking mechanism includes a rotatable block element positioned at a bottom of the housing. The rotatable block element overlies the bottom surface of the mat when the locking mechanism is in the locking position. The rotatable block element aligns with the hole in the unlocking position. In the preferred embodiment the present invention, the hole in the mat has an ovoid shape. The rotatable block has an ovoid shape slightly smaller than the ovoid shape of the hole. The rotatable block element has a cylindrical member extending outwardly from a surface thereof. The cylindrical member is received in the cavity of the housing. The cylindrical member has an inner channel extending therethrough. The inner channel extends through a thickness of the rotatable block element.

The locking mechanism further includes an annular member extending into and through the inner channel of the cylindrical member and the rotatable block element. This annular member has a closed surface at one end thereof. A shaft is affixed to the annular member and extends through an interior of the annular member so as to have an end projecting outwardly beyond the annular member. The shaft extends through an opening formed at an end of the cylindrical member opposite the rotatable block element. A panel is affixed to the end of the shaft. This panel has surfaces projecting transversely from the shaft. The surfaces are engaged with a first slot formed in the housing when the locking mechanism is in the locking position. A spring is cooperative with the annular member and with the panel. This spring urges the surfaces of the panel toward the slot such that the surfaces of the panel automatically enter the slot when the rotatable block element is rotated to the locking position. The panel has a bow-tie shape with a central portion joined to the end of the shaft and an outwardly extending portion extending radially outwardly of the central portion on opposite sides of the central portion. The opening of the cylindrical member has a square shape. The shaft has a square cross-section in a plane transverse to a longitudinal axis of the shaft. The square cross-section of the shaft is received in the square shape of the opening of the cylindrical member.

The housing has a second slot formed therein in generally parallel relation to and in communication with the first slot. The panel is in the second slot when the locking mechanism is in the unlocking position. The panel enters the first slot when the rotatable block is rotated.

The closed surface of the annular member has an interruption in the planar surface thereof. The interruption is adapted to be engaged with a tool so as to allow the tool to rotate the locking mechanism from the unlocked position to the locked position. The interruption has a geometric shape projecting outwardly of or indented into the planar surface. The tool has a complementary geometric shaped indentation or projection formed therein. This complementary geometrically-shaped indentation of the tool can be placed over the geometric shape of the interruption so as to allow the tool to rotate the annular member.

The housing has a first-half body and a second-half body affixed to the first half body. The first and second half bodies have corresponding slots formed therein. The corresponding slots are adapted to receive a portion of the locking mechanism therein. The locking mechanism has a rotatable block element with a cylindrical member extending outwardly therefrom. The cylindrical member has a shoulder circumferentially formed thereon. The shoulder bears on a shoulder within the cavity of the housing. The shoulder is adapted to retain the cylindrical member within the cavity.

This foregoing Section is intended to describe, with particularity, the preferred embodiments of the present invention. It is understood that modifications to this preferred embodiment can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
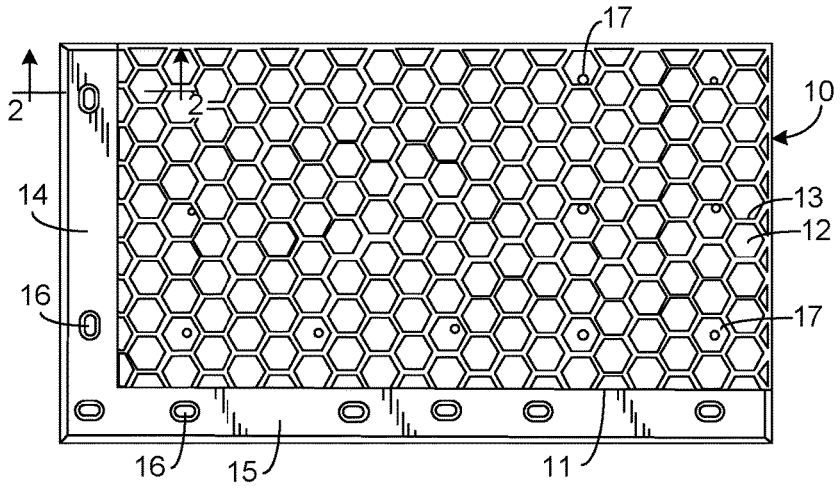
FIG. 1 PRIOR ART
FIG. 1 depicts a top plan view of a half-piece component of an individual mat of the prior art.
Figure 2:
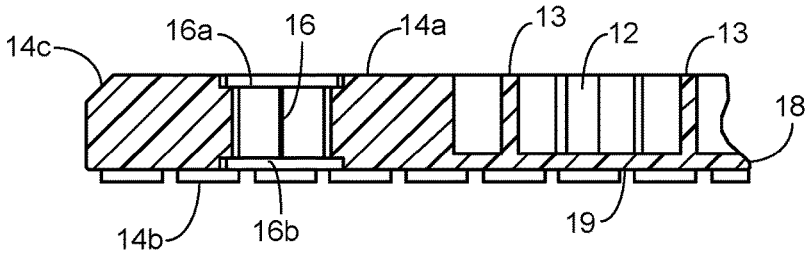
FIG. 2 PRIOR ART
FIG. 2 depicts a cross-sectional cut-away view of the half-piece component along the line 2-2 of FIG. 1 of the prior art.
Figure 3:
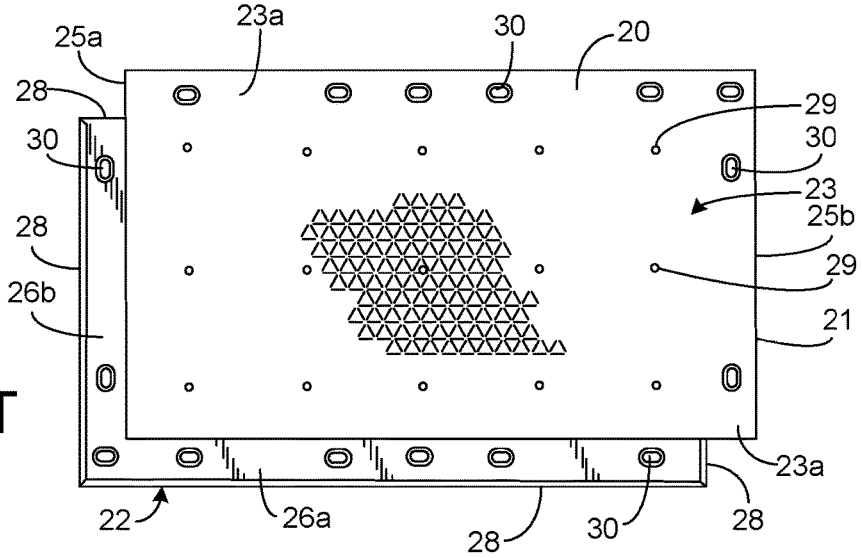
FIG. 3 PRIOR ART
FIG. 3 depicts a top plan view of an individual mat of the prior art.
Figure 4:
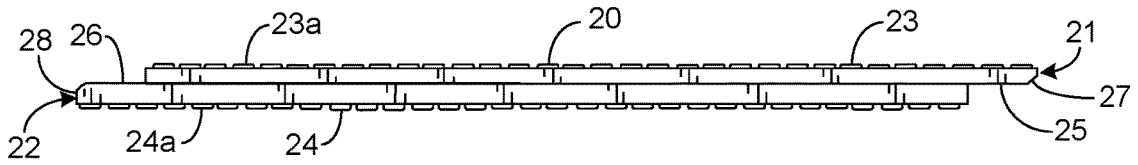
FIG. 4 PRIOR ART
FIG. 4 depicts a side view of an individual mat of the prior art.
Figure 5:
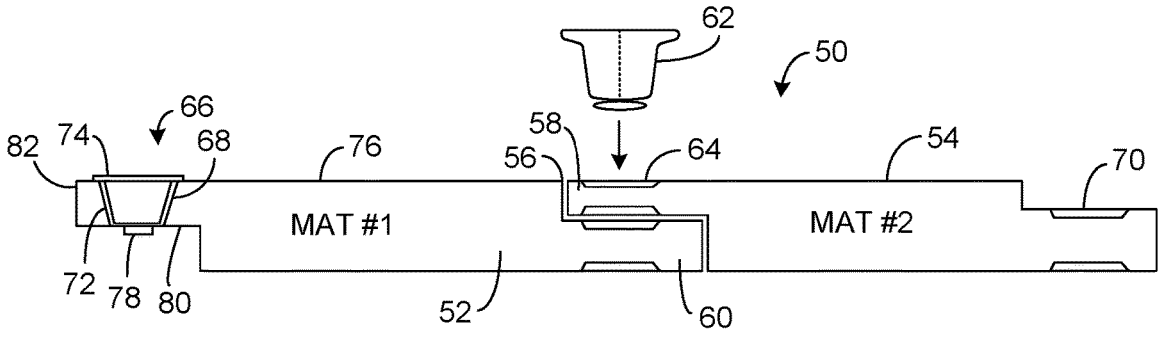
FIG. 5 is a side view, in partial cross-section, showing the placement of one mat adjacent to another mat and showing the installation of the tracking apparatus of the present invention.

Referring to FIG. 5, there is shown the tracking system 50 in accordance with the present invention. The tracking system 50 illustrates a first mat 52 and a second mat 54 that are joined together along edges 56. As can be seen, a portion 58 of the second mat 54 overlies a portion 60 of the first mat 52. A fastener (such as a pin) 62 can be inserted through the holes 64 formed in corresponding locations in each of the portions 58 and 60 of the respective mats 54 and 52. As such, the first mat 52 is secured to the second mat 54.

Importantly, as was described previously in association with FIGS. 1-4, there are a large number of holes that are formed along the peripheral edges of each of the mats 52 and 54. The present invention includes a tracking apparatus 66 that can be installed in one of the holes 68 so as to provide a tracking capability for the mat 52. A similar tracking apparatus 66 can also be installed within one of the holes 70 on the second mat 52 so as to provide a tracking capability for the second mat 52.

As can be seen in FIG. 5, the tracking apparatus 66 has a housing 72 received within the hole 68 and which generally conforms to the shape of the hole 68. A lip 74 will overlie the top surface 76 of the first mat 52. Under those circumstances where the area adjacent to the hole 68 is recessed, the lip 74 will neatly fit within this recess so as to provide a flush top surface 76 for the mat 52.

A locking mechanism 78 is positioned at the bottom of the housing 72. Locking mechanism 78 serves to secure the housing 72 within the hole 68 by overlying the bottom surface 80 of the mat 52 or by being received within a recess at the bottom of the mat. The configuration in which the locking mechanism 78 overlies the bottom surface 80 and the lip 74 overlies the top surface 76 allows the outwardly extending portion 82 of mat 52 to be secured therebetween. In the present invention, the locking mechanism 78 will be locked into this position so that it cannot be removed from its position within the hole 68. It is only when a key or other unlocking device is applied to the locking mechanism 78 that the tracking apparatus 66 can be removed from the hole 68.

Figure 6:
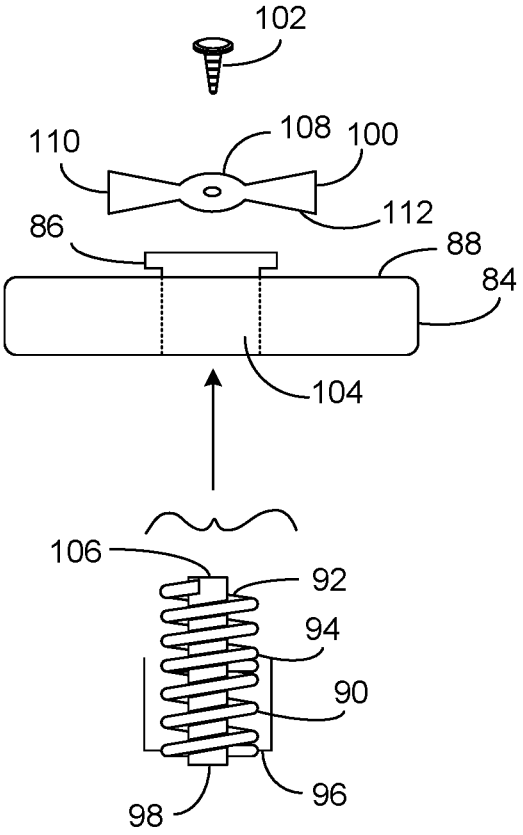
FIG. 6 is an exploded view showing the arrangement of components of the tracking apparatus of the present invention.

FIG. 6 is an exploded view showing various components on the interior of the tracking apparatus 66. In particular, FIG. 6 illustrates that there is a rotatable block element 84 having a cylindrical member 86 extending upwardly from a top surface 88 thereof. An annular member 90 is illustrated as having a shaft 92 extending upwardly through the interior thereof. A spring 84 is positioned over the shaft 92 and positioned within the interior of the annular member 90. Annular member 90 has a closed surface 96 at the bottom end thereof. An interruption 98 is formed on this bottom surface 96.

A panel 100 is illustrated as located above the cylindrical member 86 of the rotatable block element 84. Screw 102 is further illustrated as located above the panel 100. Screw 102 serves to secure the panel 100 onto the top of the shaft 92.

As illustrated by the arrow in FIG. 6, the annular member 90 is introduced into the interior channel 104 of the rotatable block element 84. As such, the shaft 92 and spring 94 will extend upwardly through this internal channel 104 and through the internal channel of the cylindrical member 86. As such, the panel 100 can be suitably screwed onto the top end 106 of the shaft 92.

As will be described further hereinafter, the panel 100 has a bow tie shape having a central portion 108 and outwardly extending widened portions 110 and 112 extending outwardly on opposite sides of the central portion 108. These widened portions 110 and 112 will engage with slots within the housing 72 of the tracking apparatus 66. The spring 94 will apply a downwardly pulling force upon the panel 100. As will be described hereinafter, this downward urging of the panel 100 will urge the panel 100 into a particular slot within the interior of the housing 72 so as to lock the rotatable block element 94 in a desired position. The top surface 88 of the rotatable block element 84 will bear against the bottom surface of the mat so as to sandwich the mat between the top surface 88 of the rotatable block element 84 and the lip 74 of the housing 72 of the tracking apparatus 66.

Figure 7:
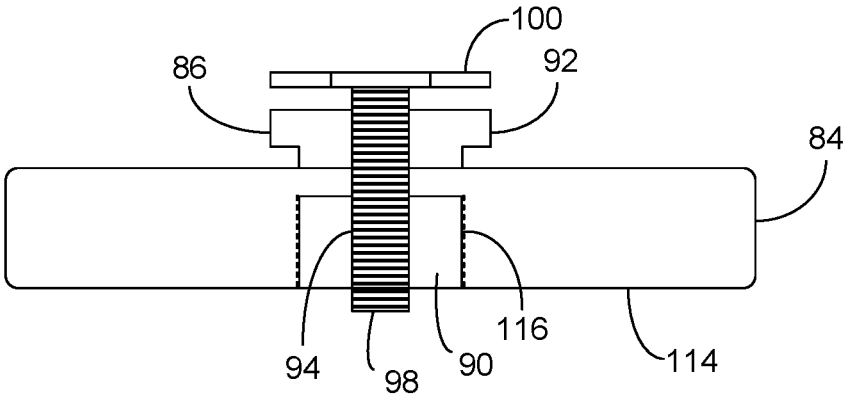
FIG. 7 is a cross-sectional view showing the installation of the various components of the tracking apparatus of the present invention, when assembled together.

FIG. 7 shows the assembly of the various components previously shown in FIG. 6. As can be seen, the rotatable block element 84 has the annular member 90 received therein. The interruption 98 extends outwardly of the bottom surface 114 of the rotatable block element 84. The interruption 98 can be in the nature of a geometric shape that is configured so as to allow a tool having a complementary geometric shape to rotate the shaft 92 for the purposes of locking and unlocking the tracking apparatus of the present invention. Spring 94 extends upwardly through the internal channel 116 of the rotatable block element 84 and extends around the exterior of the shaft 92. Ultimately, this spring 94 is joined to the panel 100 so as to urge the panel 100 downwardly. FIG. 7 further shows that the cylindrical member 86 of the rotatable block element 84 has the internal channel 116 extending therethrough. As such, the shaft 92 and the spring 94 will also extend through this internal channel.

Figure 8:
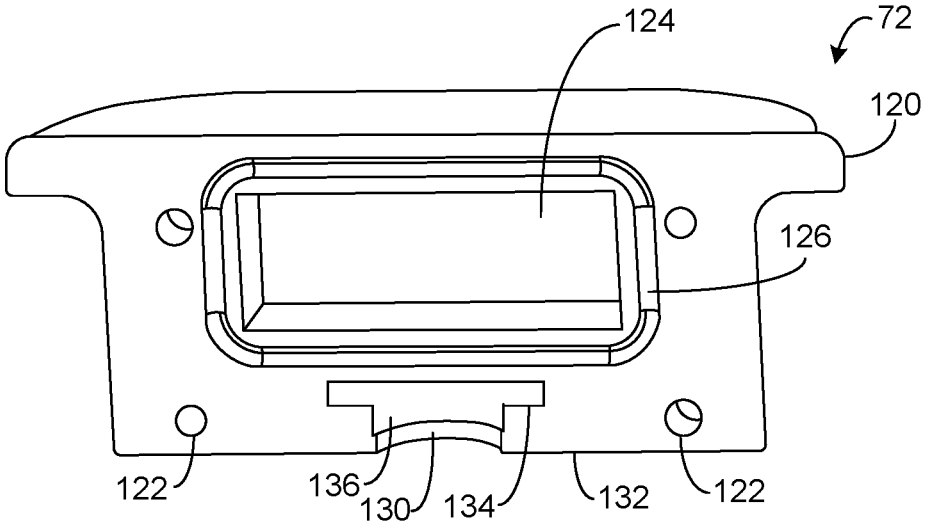
FIG. 8 is a side elevational view of the internal configuration of one half-body of the tracking apparatus of the present invention.

FIG. 8 shows one half body 120 of the housing 72. This half body 120 is configured so as to mate with an identical half body. Screw holes 122 are provided on the half body 120 so as to allow the pair of half bodies to be joined together. An internal chamber 124 is formed in the interior of the half body 120. An elastomeric seal 126 extends around the internal chamber 124 so as to provide a liquid-tight seal once the half body 120 is joined with that the corresponding half body. Ultimately, a tracking transducer is received within the internal chamber 124. The tracking transducer can be a GPS transducer, an Apple Air Tag, a cell signal locator, or various other location devices that are well known within the prior art. If a battery is required, then it can also be installed within the internal chamber 124 in a known manner. When the half body 120 is joined to a corresponding half body, screws or bolts can be inserted into the holes 122 so as to fix the half bodies together so as to form the entire housing 72. This encloses the tracking transducer in a hermetically-sealed environment. The elastomeric seal 126 will be squeezed between these half bodies so as to assure that the interior of the internal chamber 124 is completely sealed from the exterior environment.

FIG. 8 shows that the half body 120 includes a cavity 130 opening at the bottom 132 of the half body 120. Once again, the complementary half body (that will be joined to the half body 120) will have a corresponding half of the cavity 130. The cavity 130 includes a first slot 134 and a second slot 136. Ultimately, as will be described hereinafter, the first slot 130 will receive the panel 100 when the locking mechanism is in the locked position. The second slot 136 will receive the panel 100 when the locking mechanism is in the unlocked position.

Figure 9:
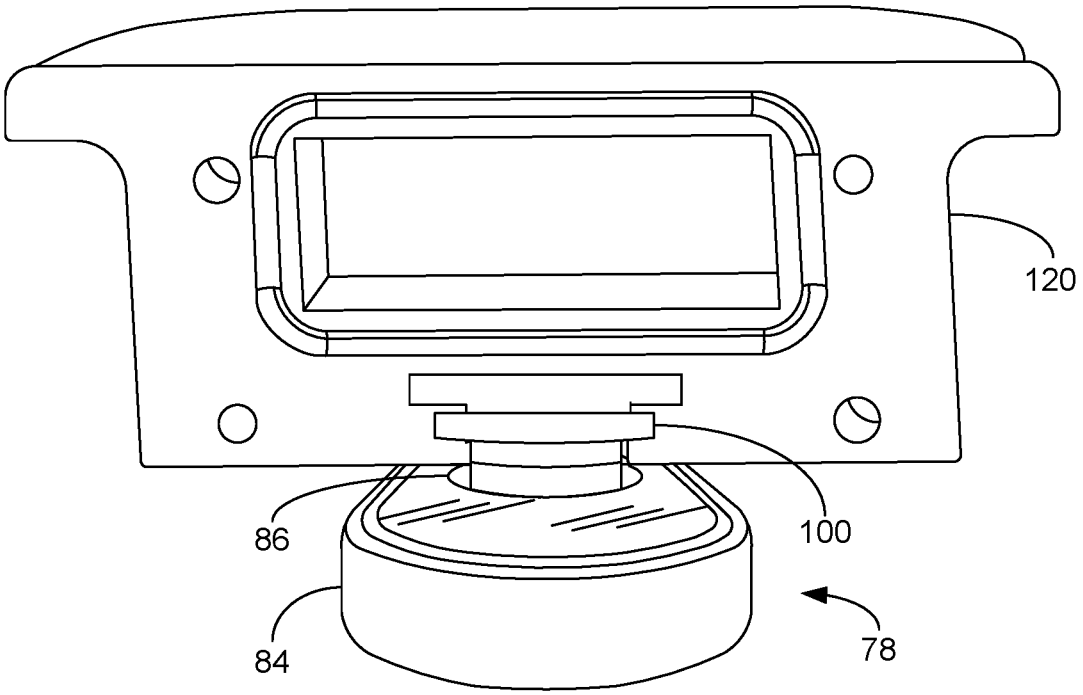
FIG. 9 is an upper perspective view showing the installation of the locking mechanism within the half-body of the tracking apparatus of the present invention.

FIG. 9 shows the half body 120 with the locking mechanism 78 positioned therein. Locking mechanism 78 includes rotatable block element 84 having the cylindrical member 86 extending upwardly therefrom. The cylindrical member 86 is shown as having the panel 100 received within the first slot 132. As such, the rotatable block element 84 extends transversely to the half body 120. In essence, this will bear against the bottom surface of the mat so as to fix the half body 120 (including the tracking transducer) in position.

Figure 10:
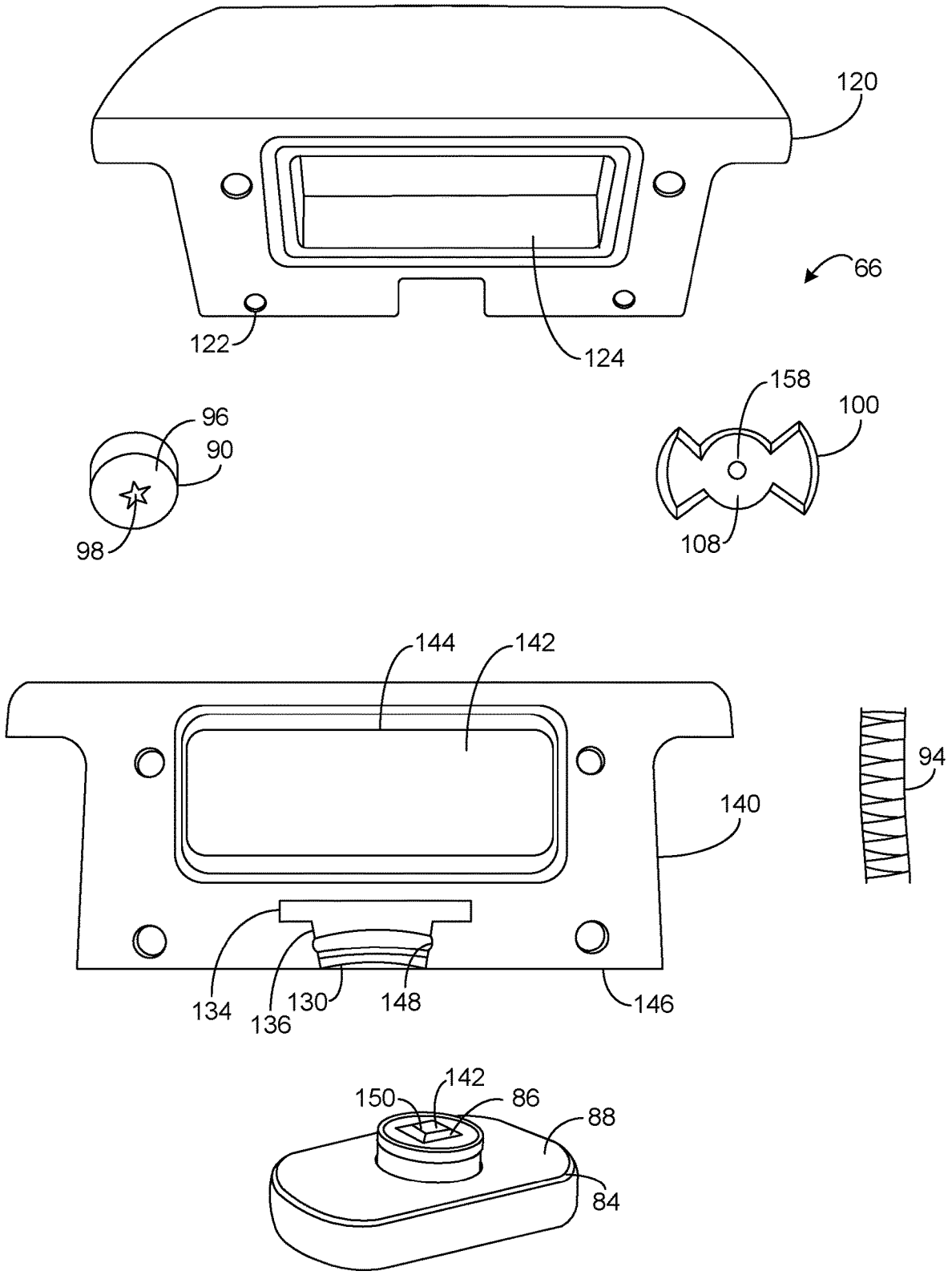
FIG. 10 is an exploded view showing the various components used in the tracking apparatus of the present invention.

FIG. 10 shows an exploded view of the tracking apparatus 66 of the present invention. In particular, FIG. 10 shows the first half body 120, a second half body 140, the annular member 90, the panel 100, the spring 94, and the rotatable block element 84. In particular, in FIG. 10, it can be seen that the rotatable block element 84 has the cylindrical member 86 extending upwardly from the top surface 88 thereof. The cylindrical member 86 has a flange 142 formed at an end of the cylindrical member 86 opposite the rotatable block element 84.

FIG. 10 shows that the half body 140 has a configuration identical to that of the half body 120. A tracking transducer 142 is illustrated is received within the internal chamber 144 of the half body 140. The internal cavity 130 at the bottom 146 of the half body 140 includes a shoulder 148 upon which the flange 142 will reside and be supported thereon. The first slot 134 and the second slot 136 are adapted to receive the panel 100 therein (depending upon the orientation of the rotatable block element 84).

Figure 12:
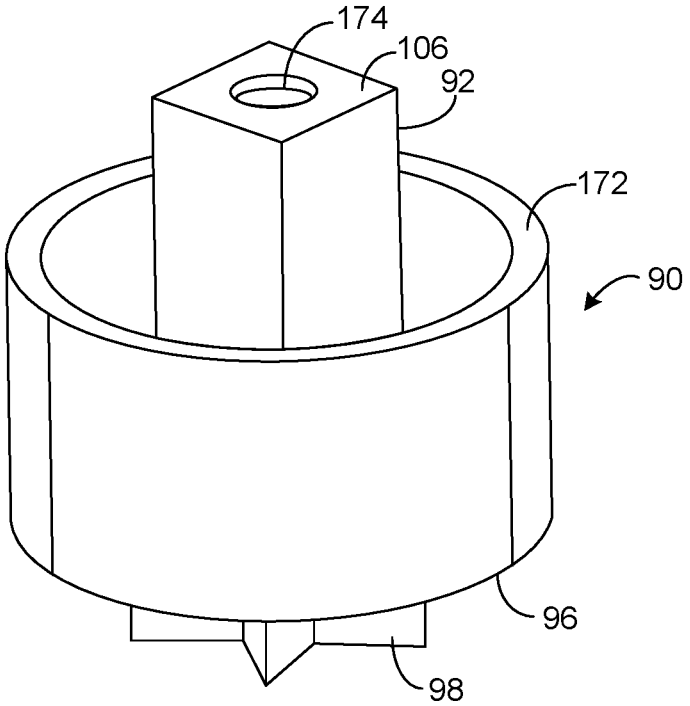
FIG. 12 is an upper perspective view showing the annular member and shaft as used in the tracking apparatus of the present invention.

The annular member 90 will have the shaft 92 extending outwardly therefrom (shown in greater detail in association with FIG. 12). This shaft will have a generally square cross-section in a plane transverse to a longitudinal axis of the shaft. This shaft will extend upwardly through the square-shaped hole 150 formed in the cylindrical member 86. The annular member 90 is illustrated as having a geometric shape 98 formed on the planar surface 96 thereof.

The panel 100 is a bow-tie shaped member having a central portion 108 with a hole 158 formed centrally thereof. Hole 158 can be joined by a fastener 102 to the top of the shaft 92. Spring 94 is positioned within the interior of the annular member 90 and can bear against an inner surface of the cylindrical member 86 adjacent to the square opening 142. The spring 94 will urge against this surface of the cylindrical member 86 so as to urge the panel 100 downwardly. As such, a rotation of the rotatable block element 84 will correspondingly rotate the shaft 92 on the annular member 90 so as to move the panel 100 from the unlocked position to the locked position. When the panel 100 overlies the first slot 136, the spring 94 will urge this panel 100 downwardly into the slot 136.

FIG. 10 further shows that the half bodies 120 and 140 can be placed in face-to-face relationship. The various mechanisms associated with the locking mechanism can be installed within the cavity 130 at the bottom of the half bodies 120 and 140. The tracking transducer can be installed within the internal chamber 142 and/or internal chamber 124. The screws or bolts can then be inserted into the various holes 122 so as to fix the half body 120 with the half body 140.

Figure 11:
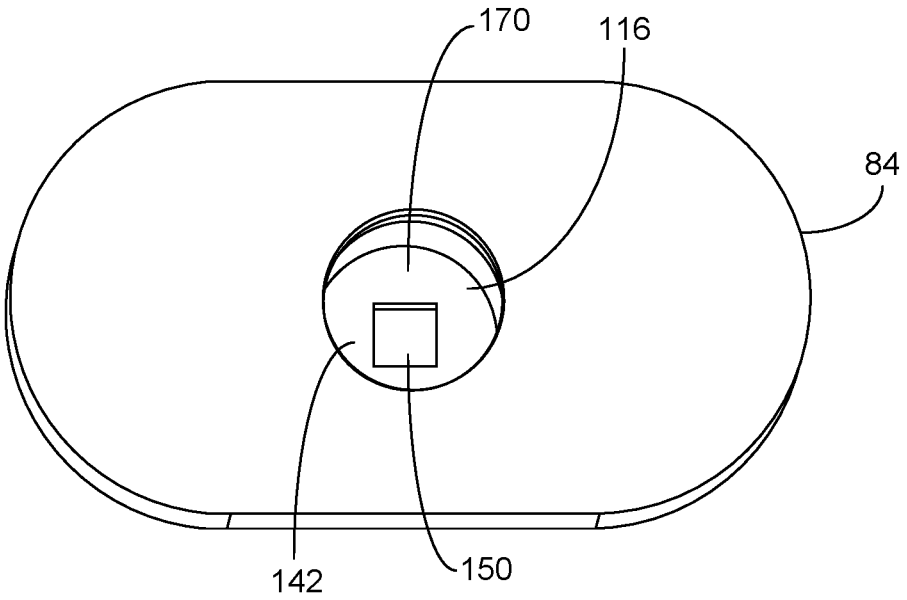
FIG. 11 is a bottom view of the rotatable block element of the present invention.

FIG. 11 shows a bottom view of the rotatable block element 184. The rotatable block element 84 has a generally ovoid configuration. This ovoid configuration will generally match the ovoid configuration of the hole in the mat. Ultimately, the size of the ovoid shape of the rotatable block element 84 will be slightly smaller than the ovoid shape of the hole in the mat. As such, when the rotatable block member 84 is aligned with the ovoid hole of the mat, the tracking apparatus can be removed from this hole in the mat for the purposes of repair or maintenance.

The rotatable block element 84 includes an internal channel 116. This channel 116 is of a circular shape and will extend to an inner wall 170 at the flange surface 142 of the cylindrical member 86. The surface 170 has a square hole 150 formed centrally therein. Square hole 150 will receive the square cross-section of the shaft 92 of the annular member. The internal channel of the rotatable block element 84 can also accommodate the outer diameter of the annular member therein.

FIG. 12 illustrates the annular member 90. Annular member 90 includes a generally tubular portion 172 and has a closed end 96. An interruption 98 is formed on the closed end 96. As is described hereinafter, the interruption 98 can be in the form of a geometric shape that can be manipulated through the use of for complementary geometrically-shaped receptacle of a tool. Alternatively, the interruption 98 can be a geometric shape that is indented inwardly of the closed end 96 such that a complementary projection from a tool can be received therein. As such, the term "interruption" should be interpreted as outwardly extending projections and inwardly extending indentations.

FIG. 12 shows that the shaft 92 extends upwardly through the interior of the tubular portion of the annular member 90. The shaft 92 is illustrated as having a square shape. Ultimately, the square cross-section of the shaft 92 will extend into the square opening 150 of the cylindrical portion 116 of the rotatable block element 94. A threaded receptacle 174 is formed is formed at the top surface 106 of the shaft 92. This allows the panel 100 to be affixed thereto through the use of the fastener 102.

Figure 13:
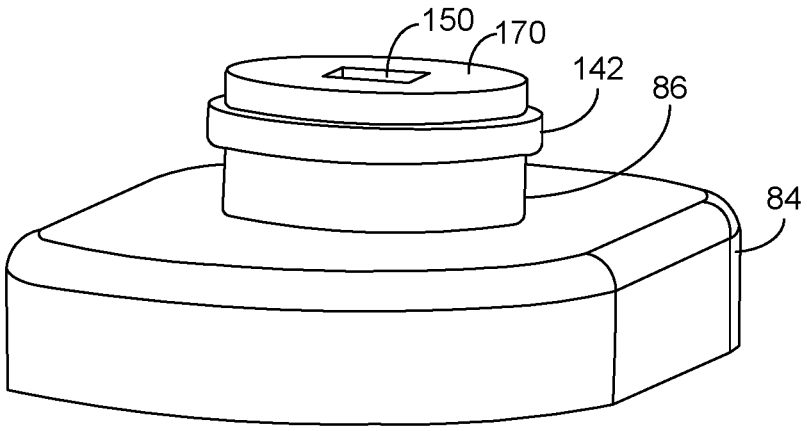
FIG. 13 is an upper perspective view of the rotatable block element of the tracking apparatus of the present invention.

FIG. 13 is an isolated view showing the rotatable block element 84. Rotatable block element 84 includes the cylindrical portion 86 extending upwardly therefrom. A flange 142 is formed so as to extend circumferentially outwardly of the cylindrical member 86. The shoulder within the cavity 130 within the housing will bear against the flange 142 so as to support the rotatable block element 84 therein. Ultimately, there is face 170 at the end of the cylindrical member 86 that encloses the interior of the cylindrical member 86, except for the square-shaped hole 150.

In general, in use, the operation of the present invention is relatively simple. When the half bodies 120 and 140 are to be assembled together, the rotatable block element 84, along with the cylindrical member 86 and the panel 100, and with the annular member 90 can also be installed within the interior of the assembled housing. As such, the panel 100 will extend outwardly so as to be received within the second slot 134. The rotatable block element 84 (having a shape corresponding to the shape of the hole in the mat) can simply be inserted through this hole so as to extend toward the bottom surface of the mat. This rotatable block element 84 can then be rotated from the unlocked position to the locked position. This causes the rotatable block element to extend crossways against the ovoid shape of the hole of the construction mat so as to have surfaces bearing against the underside of the construction mat. Similarly, the panel 100 (under the urging of the spring) will moved outwardly into the first slot 136 transverse to the previous orientation. In this manner, the transverse orientation of the panel 100 within the slot will block the rotatable lock element 84 into its proper position. When the rotatable block element is in its locked position, the rotatable block element 84 will lock the housing within the hole in combination with the lip 74 that extends outwardly of the top surface of the housing. This sandwiching assures that the tracking apparatus of the present invention is securely in position.

In order to remove the tracking apparatus, a tool is required. This tool should have an opening or a projection that is complementary to the geometric shape indented into or projecting from the closed surface of the annular member. This acts as a "key" for the opening of the tracking apparatus. Through the use of this "key", a rotational force can be applied to the rotatable block element 84 at the same time that a pushing force is applied to the annular member so as to urge the panel 100 back into the second slot 134. In this position, the halves 120 and 140 of the housing 72 can be separated for accessing the tracking device therein.

The foregoing disclosure and description of the invention is illustrative and explanatory thereof. Various changes in the details of the illustrated construction can be made is the scope of the present invention without departing from the true spirit of the invention. The present invention should only be limited by the following claims and their legal equivalents.

I claim:

1. A tracking apparatus for use with a mat, the mat having a plurality of holes formed adjacent a peripheral edge thereof, the mat having a top surface and a bottom surface, the tracking device comprising:

a housing having an internal chamber, said housing being adapted to fit into one of the plurality of holes of the mat, said housing having a cavity opening at a surface thereof, a tracking transducer position within the internal chamber of said housing; and a locking mechanism received in the cavity of said housing, said locking mechanism being rotatable between an unlocking position and a locking position, the locking position fixing said housing within the one hole of the plurality of holes of the mat, the unlocking position allowing the housing to be separated from the mat.

2. The tracking apparatus of claim 1, said housing having a lip extending outwardly from a periphery of said housing adjacent to a top of said housing, the lip adapted to overlie the top surface of the mat in an area adjacent to the one hole.

3. The tracking apparatus of claim 2, said locking mechanism comprising:

a rotatable block element positioned at a bottom of said housing, said rotatable block element overlying the bottom surface of the mat when the locking mechanism is in the locking position, said rotatable block element aligning with the one hole of the plurality of holes in the unlocking position of the locking mechanism.

4. The tracking apparatus of claim 3, wherein the one hole of the plurality of holes has an ovoid shape, said rotatable block element having an ovoid shape slightly smaller than the ovoid shape of the one hole.

5. The tracking apparatus of claim 3, said rotatable block element having a cylindrical member extending outwardly from a surface thereof, the cylindrical member being received in the cavity of said housing, the cylindrical member having an inner channel extending therethrough, the inner channel extending through a thickness of the rotatable block element.

6. The tracking apparatus of claim 5, said locking mechanism further comprising:

an annular member extending into and through the inner channel of said cylindrical member and rotatable block element, said annular member having a closed surface at one end thereof;

a shaft affixed to said annular member and extending through an interior of said annular member so as to have an end projecting outwardly the annular member, said shaft extending through an opening formed at an end of the cylindrical member opposite said rotatable block element; and a panel affixed to the end of said shaft, said panel having a surface projecting transversely from said shaft, the surface engaging a first slot formed in the housing when the locking mechanism is in the locking position.

7. The tracking apparatus of claim 6, further comprising:

a spring cooperative with said annular member and with said panel, said spring urging the surfaces of said panel toward the slot such that the surfaces of said panel automatically enter the slot when the rotatable block element is rotated to the locking position.

8. The tracking apparatus of claim 6, wherein said panel has a bow-tie shape with a central portion joined to the end of said shaft and outwardly extending portions extending radially outwardly of the central portion on opposite sides of the central portion.

9. The tracking apparatus of claim 6, wherein the opening of the cylindrical member has a square shape, the shaft having a square cross-section in a plane transverse to a longitudinal axis of said shaft, the square cross-section of said shaft being received in the square shape of the opening of the cylindrical member.

10. The tracking apparatus of claim 6, wherein said housing has a second slot formed therein in generally parallel relation to and in communication with the first slot, said panel being in the second slot when said locking mechanism is in the unlocking position, said panel entering the first slot when the rotatable block is rotated.

11. The tracking apparatus of claim 6, wherein the closed surface of said annular member has an interruption in a planar surface thereof, the interruption adapted to be engaged with a tool so as to rotate said locking mechanism from the unlocking position to the locking position.

12. The tracking apparatus of claim 11, wherein the interruption is a geometric shape projecting outwardly of the planar surface, the tool having a complementary geometrically-shaped indentation formed thereon, the complementary geometrically-shaped indentation being placeable upon the geometric shape of the interruption projecting outwardly of the planar surface.

13. The tracking apparatus of claim 1, wherein said housing comprises:

a first half body; and a second half body affixed to said first half body, said first and second half bodies having corresponding slots formed therein, the corresponding slots adapted to receive a portion of said locking mechanism therein when said locking mechanism is moved to the locking position.

14. The tracking apparatus of claim 13, wherein said locking mechanism has a rotatable block element with a cylindrical member extending outwardly therefrom, the cylindrical member having a shoulder formed thereon, the shoulder of the cylindrical member bearing on a shoulder within a cavity of said housing, the shoulder being adapted to retain the cylindrical member within the cavity.

15. A tracking apparatus comprising:

a mat having a plurality of holes formed adjacent a peripheral edge thereof, the mat having a top surface and a bottom surface;

a housing having an internal chamber, said housing being adapted to fit into one hole of the plurality of holes of the mat, said housing having a cavity opening at a surface thereof, a tracking transducer positioned within the internal chamber of said housing; and a locking mechanism received in the cavity of said housing, said locking mechanism being rotatable between an unlocking position and a locking position, the locking position fixing said housing within the one hole of the plurality of holes of said mat, the unlocking position allowing said housing to be separated from said mat.

16. The tracking apparatus of claim 15, said housing having a lip extending outwardly from a periphery of said housing adjacent to a top of said housing overlying the top surface of the mat in an area adjacent the one hole of the plurality of holes.

17. The tracking apparatus of claim 16, said locking mechanism comprising:

a rotatable block element positioned at a bottom of said housing, said rotatable block element overlying the bottom surface of said mat when the locking mechanism is in the locking position, said rotatable block element aligning with the one hole of the plurality of holes in the unlocking position of said locking mechanism.

18. The locking apparatus of claim 16, wherein the one hole of the plurality of holes has an ovoid shape, said rotatable block element having an ovoid shape slightly smaller than the ovoid shape of the one hole.

19. The tracking apparatus of claim 16, said rotatable block element having a cylindrical member extending outwardly from a surface thereof, the cylindrical member being received in the cavity of said housing, the cylindrical member having an inner channel extending therethrough, the inner channel extending through a thickness of said rotatable block element.

20. The tracking apparatus of claim 19, the locking mechanism further comprising:

an annular member extending into and through the inner channel of said cylindrical member and said rotatable block element, said annular member having a closed surface at one end thereof;

a shaft affixed to said annular member and extending through an interior of said annular member so as to have an end projecting outwardly of the annular member, said shaft extending through an opening formed at an end of said cylindrical member opposite said rotatable block element;

a panel affixed to the end of said shaft, said panel having surfaces projecting transversely from said shaft, the surfaces engaging with a slot formed in said housing when said locking mechanism is in the locking position; and a spring cooperative with said annular member and was said panel, said spring urging the surface of said panel toward the slot such that the surfaces of said panel automatically enter the slot when the rotatable block element is rotated to the locking position.

* * * * *